US011133615B2

(12) United States Patent
Liu et al.

(10) Patent No.: US 11,133,615 B2
(45) Date of Patent: Sep. 28, 2021

(54) ELECTRICAL CONNECTOR ASSEMBLY

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Ta-Lung Liu, New Taipei (TW); Kuo-Chun Hsu, New Taipei (TW); Bin Peng, Kunshan (CN); Jian-Kuang Zhu, Kunshan (CN); Ting-Ting Yin, Kunshan (CN); Yu-Jia Deng, Kunshan (CN); Cheng-Jun Zou, Kunshan (CN); Zhong-Bao Wu, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/855,363

(22) Filed: Apr. 22, 2020

(65) Prior Publication Data

US 2020/0335895 A1 Oct. 22, 2020

(30) Foreign Application Priority Data

Apr. 22, 2019 (CN) ..... 201910322270.7

(51) Int. Cl.
*H01R 13/11* (2006.01)
*H01R 13/631* (2006.01)
(Continued)

(52) U.S. Cl.
CPC ..... *H01R 13/113* (2013.01); *H01R 12/727* (2013.01); *H01R 13/055* (2013.01);
(Continued)

(58) Field of Classification Search
CPC .. H01R 13/113; H01R 13/055; H01R 13/502; H01R 13/5219; H01R 13/631; H01R 13/639; H01R 12/727
See application file for complete search history.

(56) References Cited

U.S. PATENT DOCUMENTS 5,256,085 A * 10/1993 Tan ..... H01R 12/716 439/372
6,210,240 B1 * 4/2001 Comerci ..... H01R 12/7088 439/853
(Continued)

FOREIGN PATENT DOCUMENTS

CN 106486805 B 8/2015

*Primary Examiner* — Abdullah A Riyami
*Assistant Examiner* — Nader J Alhawamdeh
(74) *Attorney, Agent, or Firm* — Ming Chieh Chang; Wei Te Chung

(57) ABSTRACT

An electrical connector assembly includes a first connector and a second connector mateable with each other wherein each of the first connector and the second connector has an insulative housing essentially composed of a bottom wall, a side wall and a pair of end walls wherein all the bottom wall and the side wall are rectangular while the end walls are right triangular. The first connector and he second connector are coupled with each other in a complementary manner with the corresponding hypotenuses of the right triangles confronting each other. A sealing member of a frame structure is located at an interface between the coupled edges of the housings in an oblique manner.

20 Claims, 7 Drawing Sheets

(51) Int. Cl.

| | |
|---|---|
| ***H01R 13/05*** | (2006.01) |
| ***H01R 13/502*** | (2006.01) |
| ***H01R 13/639*** | (2006.01) |
| ***H01R 13/52*** | (2006.01) |
| ***H01R 12/72*** | (2011.01) |

(52) U.S. Cl.
CPC ..... *H01R 13/502* (2013.01); *H01R 13/5219* (2013.01); *H01R 13/631* (2013.01); *H01R 13/639* (2013.01)

(56) References Cited

U.S. PATENT DOCUMENTS 7,438,556 B2 * 10/2008 Yi ..... H01R 12/52 439/61
7,802,994 B1 * 9/2010 Chen ..... H01R 12/732 439/65
8,267,724 B2 * 9/2012 Dodds ..... H01R 13/113 439/660
8,398,440 B2 * 3/2013 Dodds ..... H01R 12/724 439/660
8,414,310 B2 * 4/2013 Zhu ..... H01R 24/60 439/74
8,662,932 B2 * 3/2014 Annis ..... H01R 13/629 439/638
8,992,245 B2 * 3/2015 Higuchi ..... H01R 13/5202 439/272
9,178,296 B2 * 11/2015 Funamura ..... H01R 13/74
9,711,897 B2 * 7/2017 Ho ..... H01R 13/113
10,276,972 B1 * 4/2019 Lai ..... H01R 13/5216
10,461,475 B2 * 10/2019 Little ..... H01R 13/6658
2011/0104953 A1 * 5/2011 Dodds ..... H01R 13/53 439/660
2011/0130043 A1 * 6/2011 Chen ..... H01R 12/7047 439/660
2012/0289071 A1 * 11/2012 Dodds ..... H01R 12/724 439/183
2013/0090001 A1 * 4/2013 Kagotani ..... H01R 13/60 439/378
2014/0113493 A1 * 4/2014 Funamura ..... H01R 12/716 439/626
2020/0203870 A1 * 6/2020 Yin ..... H01R 13/113
2020/0335895 A1 * 10/2020 Liu ..... H01R 13/639

* cited by examiner

ELECTRICAL CONNECTOR ASSEMBLY

BACKGROUND OF THE INVENTION

1. Field of the Invention

The present invention relates to an electrical connector assembly, especially to the electrical connector assembly with an oblique interface therebetween.

2. Description of Related Arts

The copending U.S. patent application Ser. No. 16/726,911 discloses an electrical connector assembly includes a first connector with a bottom wall, an elongated side wall and two end walls while a second connector mateable with the first connector with another bottom wall and another elongated side wall so as to have the coupled whole assembly is enclosed by all six sides of a rectangular structure thereof.

Anyhow, the waterproofing sealing structure between the mated first connector and second connector is desired.

SUMMARY OF THE INVENTION

To achieve the above desire, an electrical connector assembly includes a first connector and a second connector mateable with each other wherein each of the first connector and the second connector has an insulative housing essentially composed of a bottom wall, a side wall and a pair of end walls wherein all the bottom wall and the side wall are rectangular while the end walls are right triangular. The first connector and he second connector are coupled with each other in a complementary manner with the corresponding hypotenuses of the right triangles confronting each other. A sealing member of a frame structure is located at an interface between the coupled edges of the housings in an oblique manner.

DETAILED DESCRIPTION OF THE PREFERRED EMBODIMENT

Figure 1:
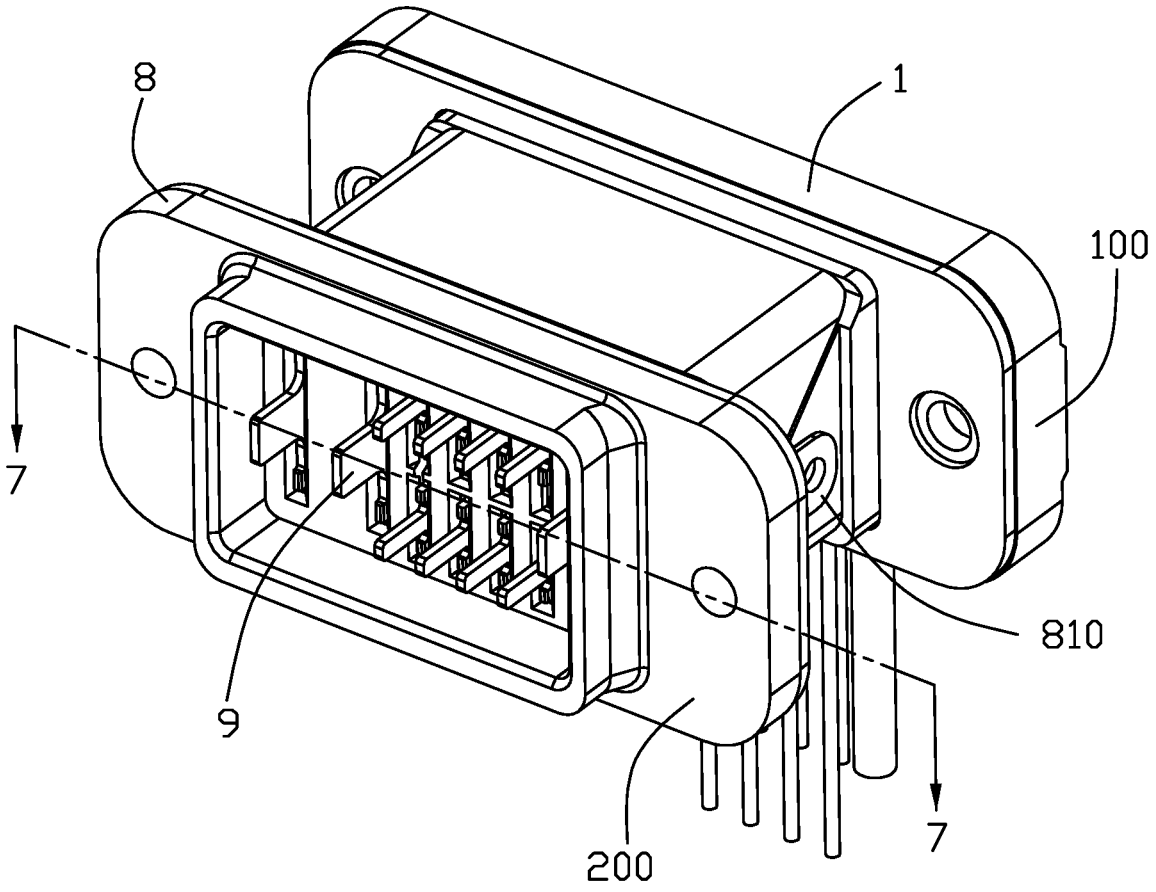
FIG. 1 is a perspective view of an electrical connector assembly of an embodiment of this present invention.
Figure 2:
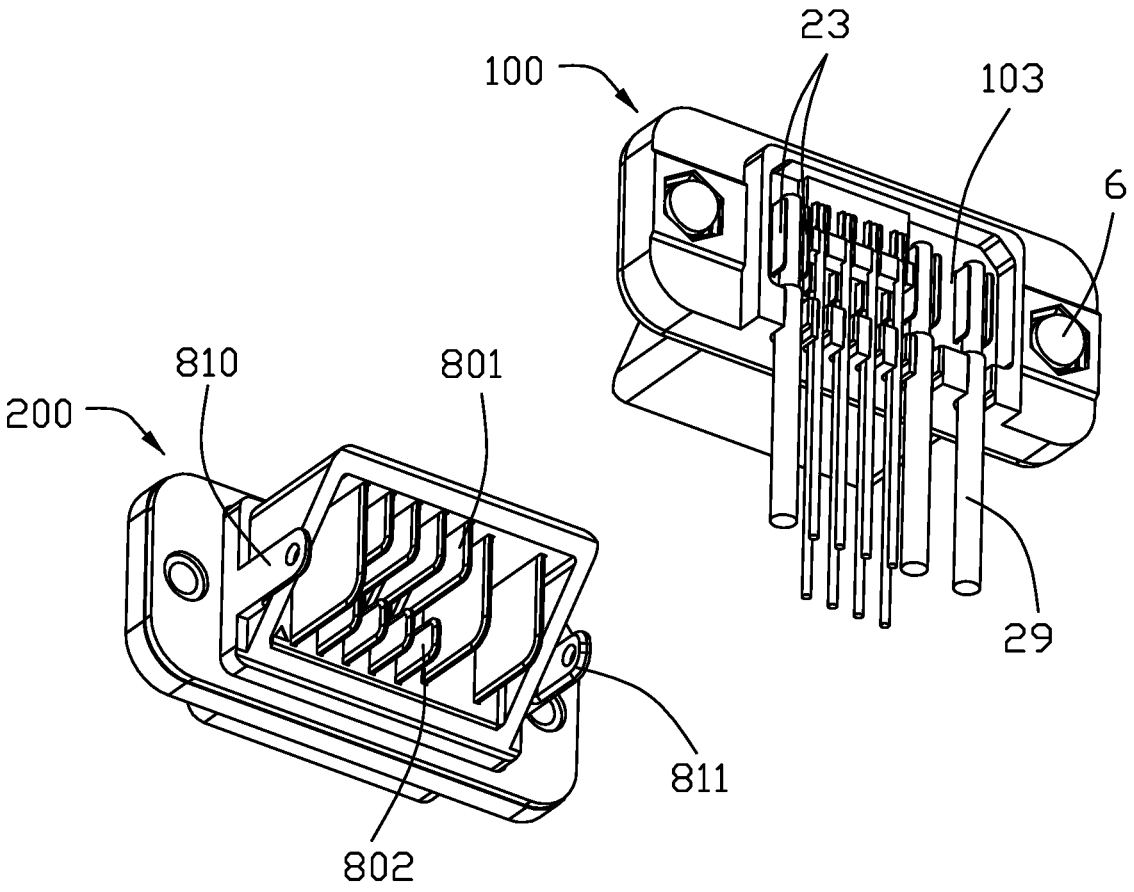
FIG. 2 is a perspective view of the electrical connector assembly of FIG. 1 wherein the plug connector and the receptacle connector are separated from each other.
Figure 3:
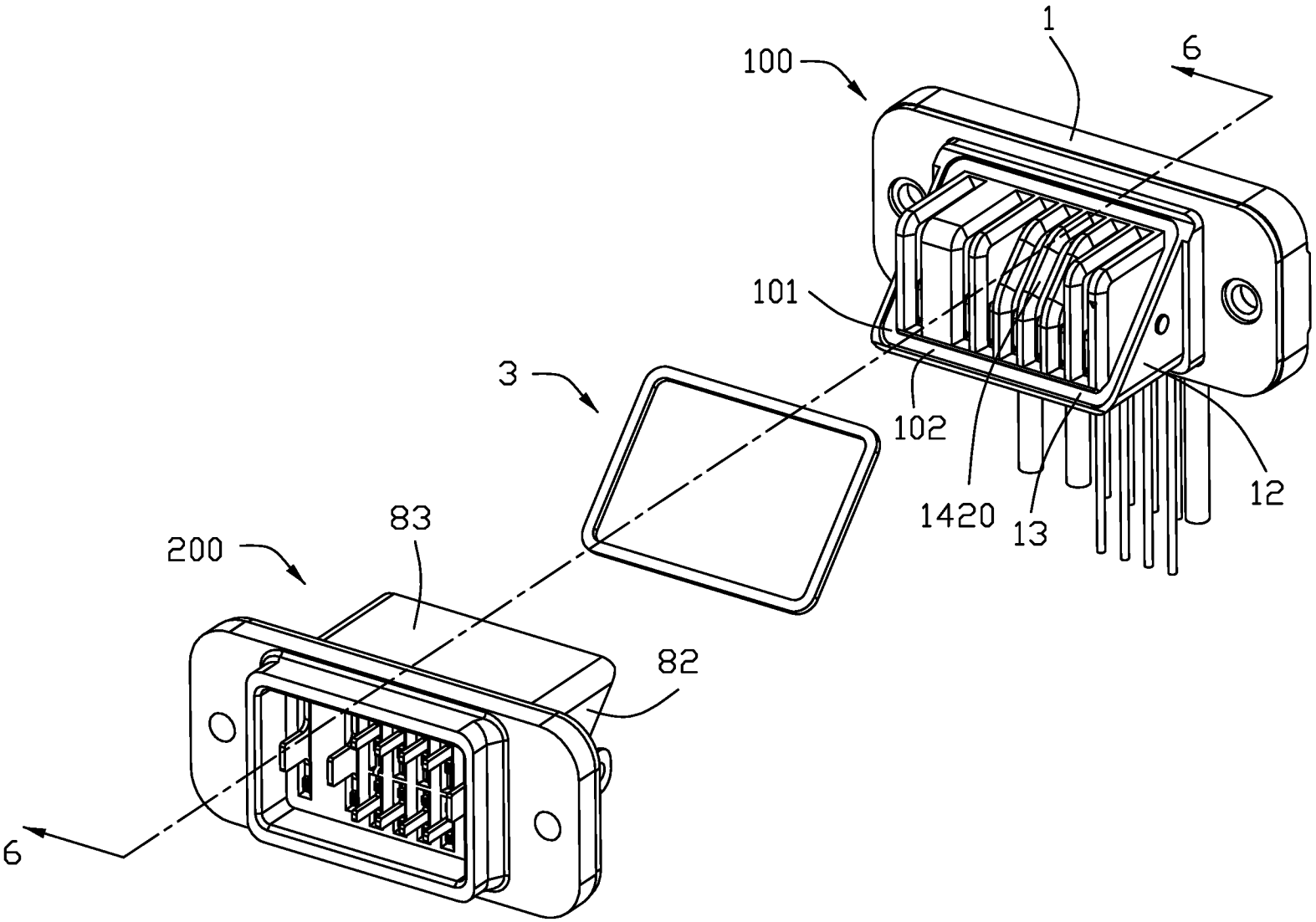
FIG. 3 is another perspective view of the electrical connector assembly of FIG. 2 wherein the sealing member is removed away from the plug connector and the receptacle connector.
Figure 4:
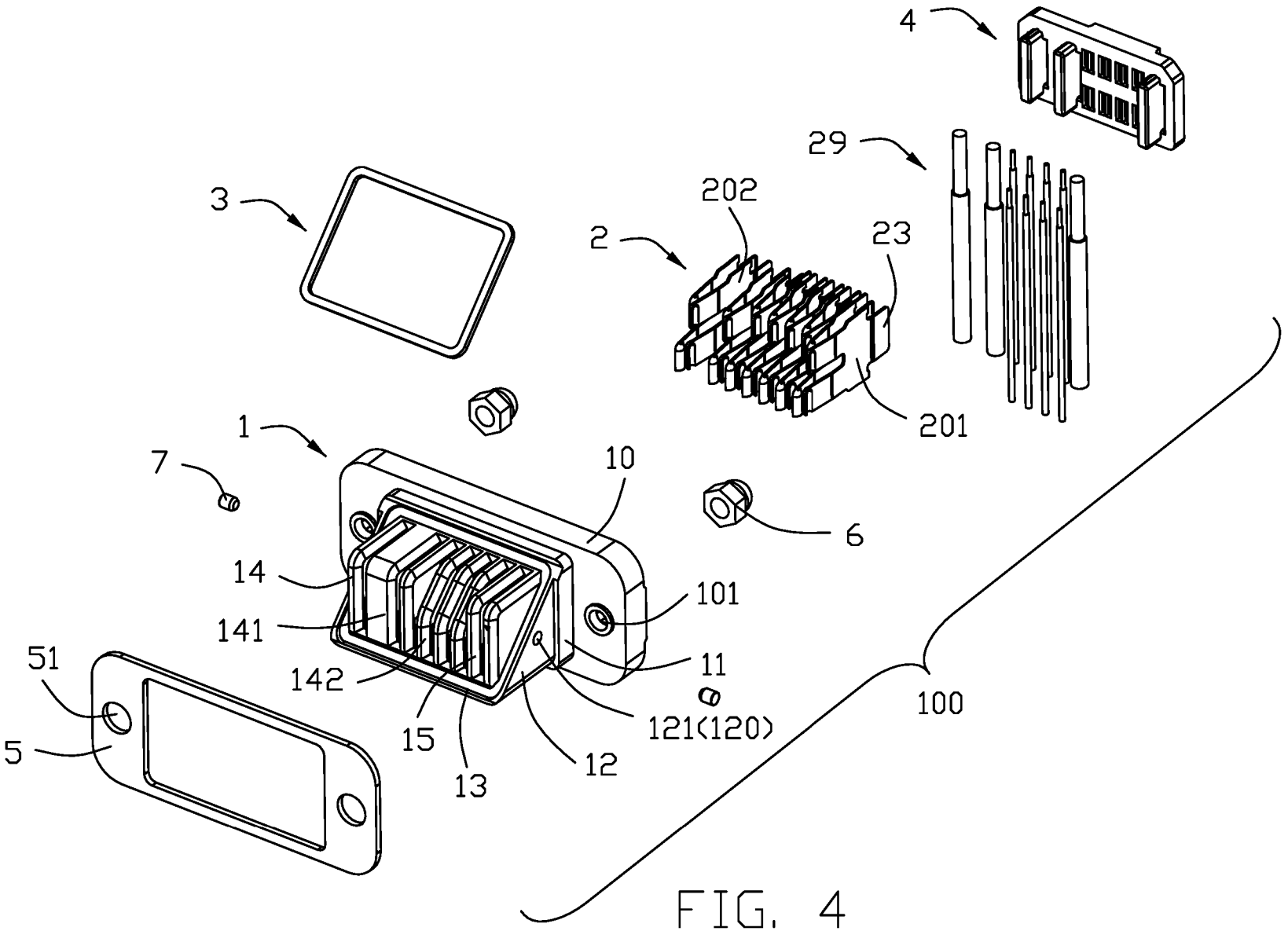
FIG. 4 is an exploded perspective view of the receptacle connector of the electrical connector assembly of FIG. 1.
Figure 5:
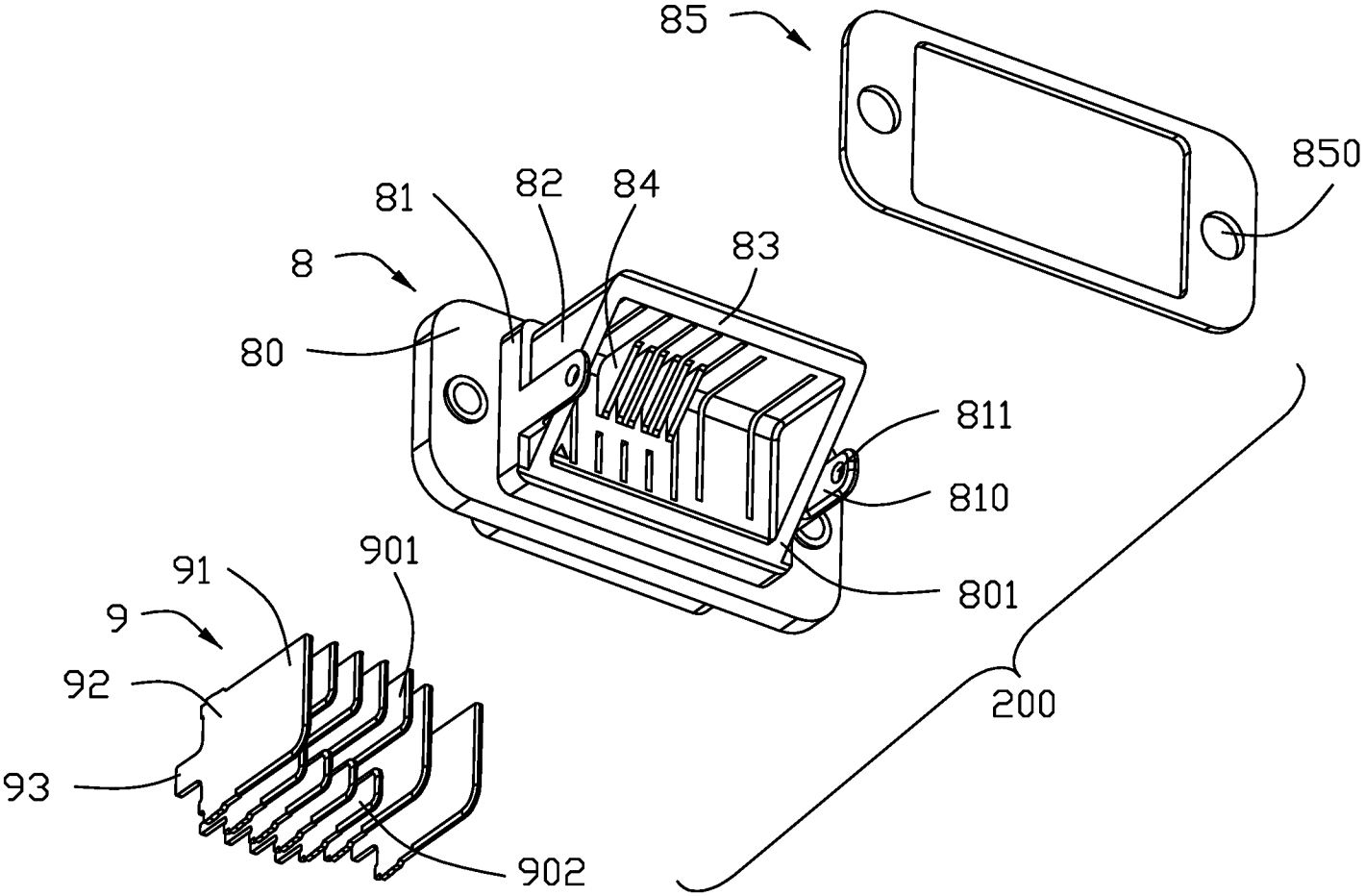
FIG. 5 is an exploded perspective view of the plug connector of the electrical connector assembly of FIG. 1.

Referring to FIGS. 1-7, an electrical connector assembly includes a receptacle connector 100 and a plug connector 200 mateable with each other along a front-to-back direction. Each of the receptacle connector 100 and the plug connector 200 forms a mating opening exposed to an exterior in both the horizontal direction and the vertical direction.

The receptacle connector 100 includes an insulative receptacle housing 1, a plurality of receptacle contacts 2 retained to the receptacle housing 1, a waterproofing sealing member 3, a plurality of wires 29 connected to tails of the receptacle contacts 2, and a waterproofing plate covering the back of the receptacle housing 1.

Figure 6:
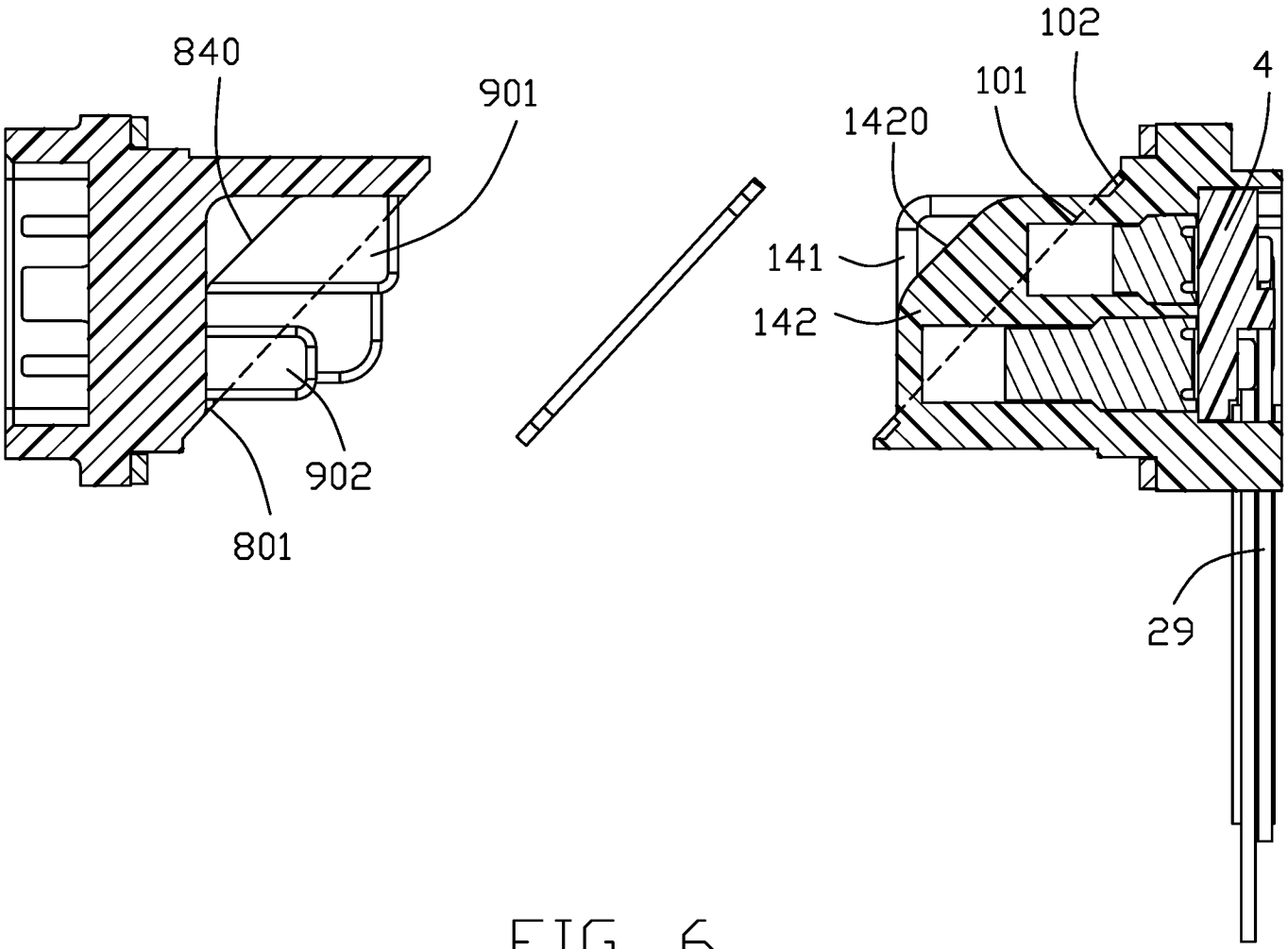
FIG. 6 is a cross-sectional view of the electrical connector assembly of FIG. 3 along line 6-6.
Figure 7:
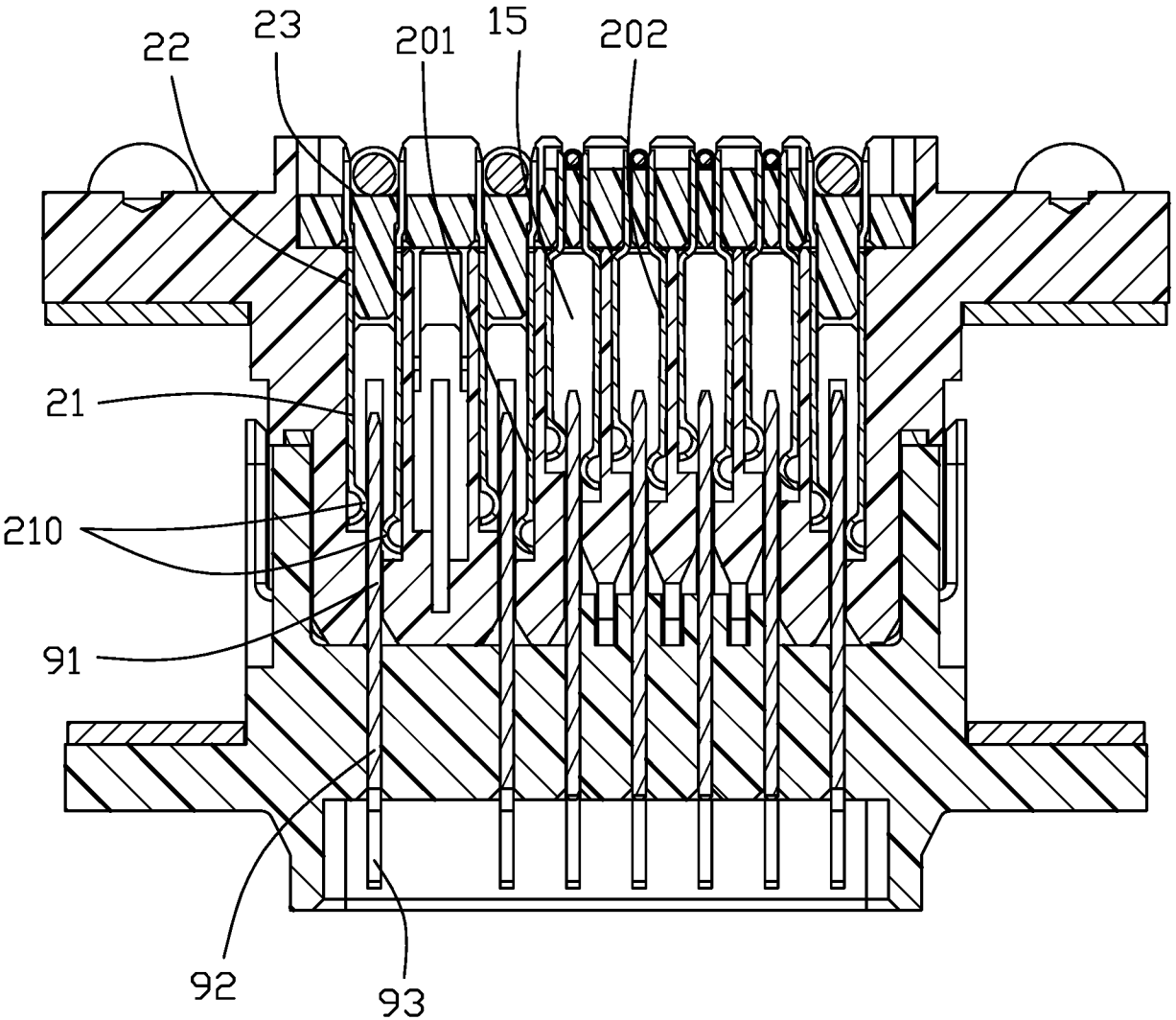
FIG. 7 is a cross-sectional view of the electrical connector assembly of FIG. 1 along line 7-7.

The receptacle housing 1 includes a base 10, a floor wall 11 located in front of the base 10 along the front-to-back direction. The base 10 extends laterally beyond two ends of the floor wall 11 in the transverse direction perpendicular to the front-to-back direction with a pair of securing holes 104. In this embodiment, the base 10 and the floor wall 11 are unitary with each other. A pair of end walls 12 and a side wall 13 extend forwardly from the floor wall 11 along the front-to-back direction wherein the pair of end walls 12 are parallel to each other while the side wall 13 perpendicular to said pair of end walls 12. The side wall 13 is rectangular while the pair of end walls 12 are right triangular. The end walls 12 form locking pieces 120. The front edges of the side wall 13, the end walls 12 and the floor wall 11 commonly form an (oblique) receptacle front/mating plane/face 101 which is oblique/angled with regard to the base 10 as shown in FIG. 6. The receptacle front plane 101 forms a groove 102 to receive the waterproofing sealing member 3 therein. The receptacle housing 1 further includes a plurality of partitions 14 extending forwardly from the base 1 and located between the pair of end walls 12 in a parallel relation. A plurality of passageway 15 are formed between the neighboring partitions 14. The receptacle contacts 2 are disposed in the corresponding passageways 15, respectively. Notably, the partitions 14 extend forwardly beyond the receptacle front plane 101 in exposure. The partitions 14 include the rectangular ones 141 and the chamfered one 142 wherein the rectangular ones 141 further include a thickened one wherein the chamfered one has the chamfer 1420 parallel to the receptacle front plane 101.

The contacts 2 include the long contacts 201 and the short contacts 202 wherein the long contacts 201 extend forward beyond the short contacts 202, and are located closer to the side wall 13 than the short contacts 202. The contact 2 includes a retaining section 22 retained to the floor wall 11, a contacting section 21 extending forwardly from the retaining section 22 and into the corresponding passageway 15 with the bulged section 210, and a tail/soldering section 23 extending rearwardly from the retaining section 22 and exposed outside of the base 11 for soldering with the corresponding wire 29. The wires 29 are soldered with the tails 23 in a perpendicular manner, and the waterproofing plate 4 covers the back of the receptacle housing 1 and occupies the space behind the base 11 for sealing gaps.

The receptacle connector 100 further includes a metallic shell 5 covering a front face of the base 10, and a pair of nuts 6 retained to the corresponding securing holes 104 and the through holes 51 of the shell 5 for fastening the shell 5 upon the base 11. The locking pin/piece 7 is retained in the locking hole 102.

The plug connector 200 include an insulative plug housing 8 and a plurality of plug contacts 9 retained to the plug housing 8. The basic structure of the plug connector 200 is similar to that of the receptacle contact 100.

The plug housing 8 includes a base 80 and a floor wall 81 extending forwardly form the base 80 along the front-to-back direction wherein the base 80 extend laterally beyond the floor wall 81 in the transverse direction perpendicular to the front-to-back direction. The floor wall 81 and the base 80 are unitary with each other. The base 80 forms a pair of securing holes 802. A metallic shell 85 covers the base 80 with the pair of holes 850 aligned with the corresponding securing holes 802 and commonly secured together. A side wall 83 and a pair of end walls 82 forwardly extend from the base 81 wherein the pair of end walls 82 are parallel to each other while the side wall 83 is perpendicular to the pair of end walls 82. The end walls 82 are right triangular. An (oblique) plug front/mating plane/face 801 is formed by front edges of the pair of end walls 82, the side wall 83 and the floor wall 81, and is oblique/angle with regard to the base 80. A pair of locking arms 810 extend from the floor wall 81 and located by two sides of the end walls 82 with locking holes 811 which are aligned with the corresponding locking pieces 120 so as to be secured together by the corresponding locking pins 7, thus retaining the plug connector 200 and the receptacle connector 100 together. A plurality of right triangular partitions 84 are located between the pair of end walls 82. The hypotenuses 840 of the right angular partitions are parallel to the plug front plane 801. During mating, the partitions 84 abut against the partitions 142 with the hypotenuses 840 of the partitions 84 and the chamfers 1420 of the partitions 142 abut against each other.

The plug contacts 9 include along contacts 901 for mating with the short contacts 202, and short contacts 902 for mating with the long contacts 201. The long contacts 901 are closer to the side all 83 than the short contacts 902 are. The contacts 9 are planar and located between the pair of end walls 82 in a parallel relation. The contacts 9 forwardly extend beyond the plug front plane 801. The contact 9 includes a retaining section 92 retained to the base 81, a contacting section 91 forwardly extending from the retaining section 92 and exposed between the pair of end walls 82, and a tail/soldering section 93 extending rearwardly from the retaining section 92 and exposed outside of the base 80. During mating, the contacting sections 91 extend into the corresponding passageways 15 and sandwiched by the bulged sections 210 of the corresponding contacting sections 21, respectively.

Notably, the receptacle front plane 101 and the plug front plane 801 are rectangular with a frame like structure. The sealing member 3 is tightly sandwiched between the receptacle front plane 101 and the plug front plane 801. From a technical viewpoint, the triangular end walls 12 cooperate with the triangular end walls 82 to commonly form complete rectangular/square end wall units. The obliquely extending hypotenuses of the end walls 12, 82 may lengthen the interface dimension therebetween, and provide multi-directional way during the coupling/mating procedure conveniently. In brief, in the instant invention, the plug connector forms an oblique plug mating opening, and the receptacle connector forms another oblique receptacle mating opening complementary with the oblique plug mating opening so as to have the assembled/mated plug connector and receptacle connector extending along the front-to-back (mating) direction.

What is claimed is:

1. An electrical connector assembly comprising:

a receptacle connector including:

an insulative receptacle housing forming an oblique receptacle mating face;

a plurality of receptacle contacts retained to the receptacle housing and spaced from one another in a transverse direction, and extending essentially along a front-to-back direction perpendicular to the transverse direction; and a plug connector including:

an insulative plug housing forming an oblique plug mating face;

a plurality of plug contacts retained to the plug housing and spaced from one another in the transverse direction and extending along essentially along the front-to-back direction; wherein during mating, the oblique receptacle mating face and the oblique plug mating face abut against each other in both the front-to-back direction and a vertical direction perpendicular to both the transverse direction and the front-to-back direction; wherein the receptacle housing includes a floor wall, and a pair of opposite end walls extending forwardly from the floor wall of the receptacle housing in the front-to-back direction, and the oblique receptacle mating face is formed on the opposite end walls of the receptacle housing; wherein the plug housing includes a floor wall, and a pair of opposite end walls spaced from the corresponding neighboring plug contacts in the transverse direction and extending forwardly from the floor wall of the plug housing in the front-to-back direction, and the oblique plug mating face is formed on the opposite end walls of the plug housing.

2. The electrical connector assembly as claimed in claim 1, wherein each of the oblique receptacle mating face and the oblique plug mating face defines a rectangular frame configuration.

3. The electrical connector assembly as claimed in claim 2, wherein a sealing member is sandwiched between the oblique receptacle mating face and the oblique plug mating face.

4. The electrical connector assembly as claimed in claim 1, wherein each of the pair of end walls of the receptacle housing has a right triangular configuration portion, and each of the end walls of the plug housing has another right triangular configuration portion complementary with that of the end wall of the receptacle housing, and during mating the pair of end walls of the receptacle housing are aligned with the pair of end walls of the plug housing in the front-to-back direction.

5. The electrical connector assembly as claimed in claim 4, wherein the receptacle housing further includes a side wall between the corresponding pair of end walls, and the plug housing further includes a side wall between the corresponding pair of end walls and opposite, in the vertical direction, to the side wall of the receptacle housing during mating.

6. The electrical connector assembly as claimed in claim 4, wherein the receptacle housing further includes a plurality of partitions between the corresponding pair of end walls, and said partitions extend beyond the oblique receptacle mating face.

7. The electrical connector assembly as claimed in claim 6, wherein the plug housing further includes a plurality of partitions between the corresponding pair of end walls, and said partitions of the plug housing are hidden behind the oblique plug mating face so as to confront the partitions of the receptacle housing during mating in the front-to-back direction.

8. The electrical connector assembly as claimed in claim 7, wherein the partitions of the receptacle housing form chamfers parallel to oblique receptacle mating face, and the partitions of the plug housing form hypotenuses parallel to the oblique plug mating face.

9. The electrical connector assembly as claimed in claim 6, wherein a plurality of passageways formed between adjacent partitions, respectively, and the receptacle contacts are disposed in the corresponding passageways, respectively, and the plug contacts are inserted into the corresponding passageways to engage the corresponding receptacle contacts, respectively.

10. The electrical connector assembly as claimed in claim 6, wherein some of the partitions of the receptacle housing are rectangular.

11. The electrical connector assembly as claimed in claim 4, wherein a pair of locking devices secure the pair of end walls of the receptacle housing and the pair of end walls of the plug housing so as to secure the receptacle housing and the plug housing together.

12. The electrical connector assembly as claimed in claim 11, wherein the pair of locking devices include a pair of locking arms extending from a floor wall of one of the plug housing and the receptacle housing.

13. A receptacle connector for mating with a plug connector having an insulative plug housing with an oblique plug mating face and a plurality of plug contacts retained in the plug housing, comprising:

an insulative receptacle housing including a base having a pair of securing holes on two lateral ends in a transverse direction, a floor wall in front of the base in a front-to-back direction perpendicular to the transverse direction, a side wall and a pair of end walls commonly extending forwardly from the floor wall in the front-to-back direction, said pair of end walls being spaced from each other in the transverse direction; and a plurality of receptacle contacts retained in the receptacle housing between the pair of end walls in the transverse direction, and spaced from one another in said transverse direction; wherein front edges of the pair of end walls and the side wall commonly form an oblique receptacle mating face so as to form an oblique mating opening of the receptacle housing which is open to an exterior in both the front-to-back direction and a vertical direction perpendicular to both the front-to-back direction and the transverse direction; wherein each of the end walls includes a right triangular configuration portion to form the oblique receptacle mating face thereon.

14. The receptacle connector as claimed in claim 13, wherein a waterproofing sealing member is applied upon the oblique receptacle mating face.

15. The receptacle connector as claimed in claim 14, wherein said oblique receptacle mating face is of a rectangular frame configuration.

16. The receptacle connector as claimed in claim 13, further including a plurality of partitions extending forwardly from the floor wall in the front-to-back direction and beyond the oblique receptacle mating face.

17. The receptacle connector as claimed in claim 16, wherein some of the partitions are rectangular while others are of a chamfered structure.

18. The receptacle connector as claimed in claim 16, wherein a plurality of passageways are formed between adjacent partitions, respectively, to receive the corresponding receptacle contacts, and the receptacle contact extend forwardly beyond the oblique receptacle mating face in the front-to-back direction.

19. A plug connector for mating with a receptacle connector having an oblique receptacle mating face, comprising:

an insulative plug housing including a base, a floor wall positioned in front of the base in a front-to-back direction, a side walls and a pair of end walls commonly extending forwardly from the floor wall in the front-to-back direction, said pair of end walls spaced from each other in a transverse direction perpendicular to the front-to-back direction; and a plurality of plug contacts retained in the plug housing; wherein front edges of the side wall and the pair of end walls commonly form an oblique plug mating face for compliantly coupling to the oblique receptacle mating face in a complementary manner so as to commonly form a pair of rectangular end wall units during mating; wherein the plug contacts forwardly extend beyond the oblique plug mating face in the front-to-back direction; wherein each of the end walls includes a right triangular configuration portion to form the oblique plug mating face thereon, and is spaced from the corresponding neighboring plug contact in the transverse direction.

20. The plug connector as claimed in claim 19, wherein a pair of resilient locking arms are located by two opposite sides of the end walls for securing the receptacle housing during mating.

* * * * *